United States Patent [19]

Gilomen

[11] 4,171,610

[45] Oct. 23, 1979

[54] CALENDAR WATCH MOVEMENT

[75] Inventor: Beat Gilomen, Bienne, Switzerland

[73] Assignee: A. Schild S.A., Switzerland

[21] Appl. No.: 801,790

[22] Filed: May 31, 1977

[30] Foreign Application Priority Data

Jun. 16, 1976 [CH] Switzerland ..... 7693/76

[51] Int. Cl.[2] ..... G04B 19/24; G04B 19/02; G09D 3/06; G09D 3/08

[52] U.S. Cl. ..... 58/58; 40/111; 40/113; 58/5; 58/125 B

[58] Field of Search ..... 58/58, 59, 3–7, 58/125 R, 125 B, 125 C, 126 R, 126 A, 126 C, 126 D, 126 E

[56] References Cited

U.S. PATENT DOCUMENTS

| | | | |
|---|---|---|---|
| 3,789,602 | 2/1974 | Nemoto | 58/58 |
| 3,859,783 | 1/1975 | Wuthrich | 58/58 |
| 3,882,669 | 5/1975 | Jakob | 58/58 |

*Primary Examiner*—Edith S. Jackmon
*Attorney, Agent, or Firm*—Stevens, Davis, Miller & Mosher

[57] ABSTRACT

Driving mechanism for a calendar watch mechanism including indicia of day and date, a display window and means to advance said day and date indicia to said window, characterized by a calendar wheel which makes one revolution each 24 hours, a drive element on that wheel, a rapid advance member, a cocking element, the rapid advance member being elastically acted on and having a ramp which cooperates with the cocking element to control the rotation of the calendar wheel.

10 Claims, 8 Drawing Figures

CALENDAR WATCH MOVEMENT

BACKGROUND OF THE INVENTION

1. Field of the Invention

The object of the present invention is a calendar watch movement comprising at least one intermittently advancing calendar-indicating member provided with a toothing, and a drive mechanism comprising a driving member driven in rotation continuously by the movement, at least one drive member cooperating with the toothing of the said indicating member to cause its intermittent advance, and a coupling with angular play between the drive member and a driven member also forming part of said mechanism.

2. Description of the Prior Art

The German Patent Application (German unexamined application for Pat. No. 25 46 643) describes a watch movement without coupling with angular play, in which a calendar wheel of simple construction cooperates directly via drive members, with the toothing of a date ring and with the toothing of a day star. The calendar wheel extends partially below the date ring but, in view of its small size, it can be housed in a recess in the pillar plate, so that it does not increase the thickness of the movement. However, this known calendar movement does not assure an instantaneous advance of the calendar indicating members, which is considered in practice to be a major drawback.

Other calendar watch movements, known in particular from Swiss Pat. Nos. 473,417 and 575,140, comprise calendar mechanisms which assure an instantaneous advance of the indicating member or members. The mechanism in accordance with Swiss Pat. No. 473,417 uses a coupling with angular play between a calendar wheel which is driven continuously at the rate of one revolution per 24 hours and a cam which is acted on by a rapid-advance member and which bears a finger for the driving of the date ring. However, this construction does not assure the driving of a date ring located at the periphery of the movement, and the arrangement of the calendar wheel and of the rapid-advance member leads to a bulkier embodiment than the arrangement of the movement described in the aforementioned German patent application.

SUMMARY OF THE INVENTION

The object of the present invention is to simplify the construction of the mechanisms described in the aforementioned patents and to decrease their size without losing the advantages which result from the fact that the drive member is so arranged as to block the calendar member or members after the switching and therefore to prevent any of said members from erroneously advancing by two steps at the time of the switching.

For this purpose, the calendar mechanism in accordance with the invention, which is of the type mentioned at the start, is characterized by the fact that a calendar wheel which makes one revolution on itself every 24 hours and bears the said drive element or elements as well as a cocking element is driven by the said driven member and by the fact that the mechanism furthermore comprises a rapid-advance member which is acted on elastically and has a ramp which cooperates with the cocking element to effect the rotation of the calendar wheel.

BRIEF DESCRIPTION OF THE DRAWINGS

One embodiment and several variants of the mechanism in accordance with the invention will be described below by way of illustration with reference to the drawing, in which.

DESCRIPTION OF THE PREFERRED EMBODIMENT

Figure 1:
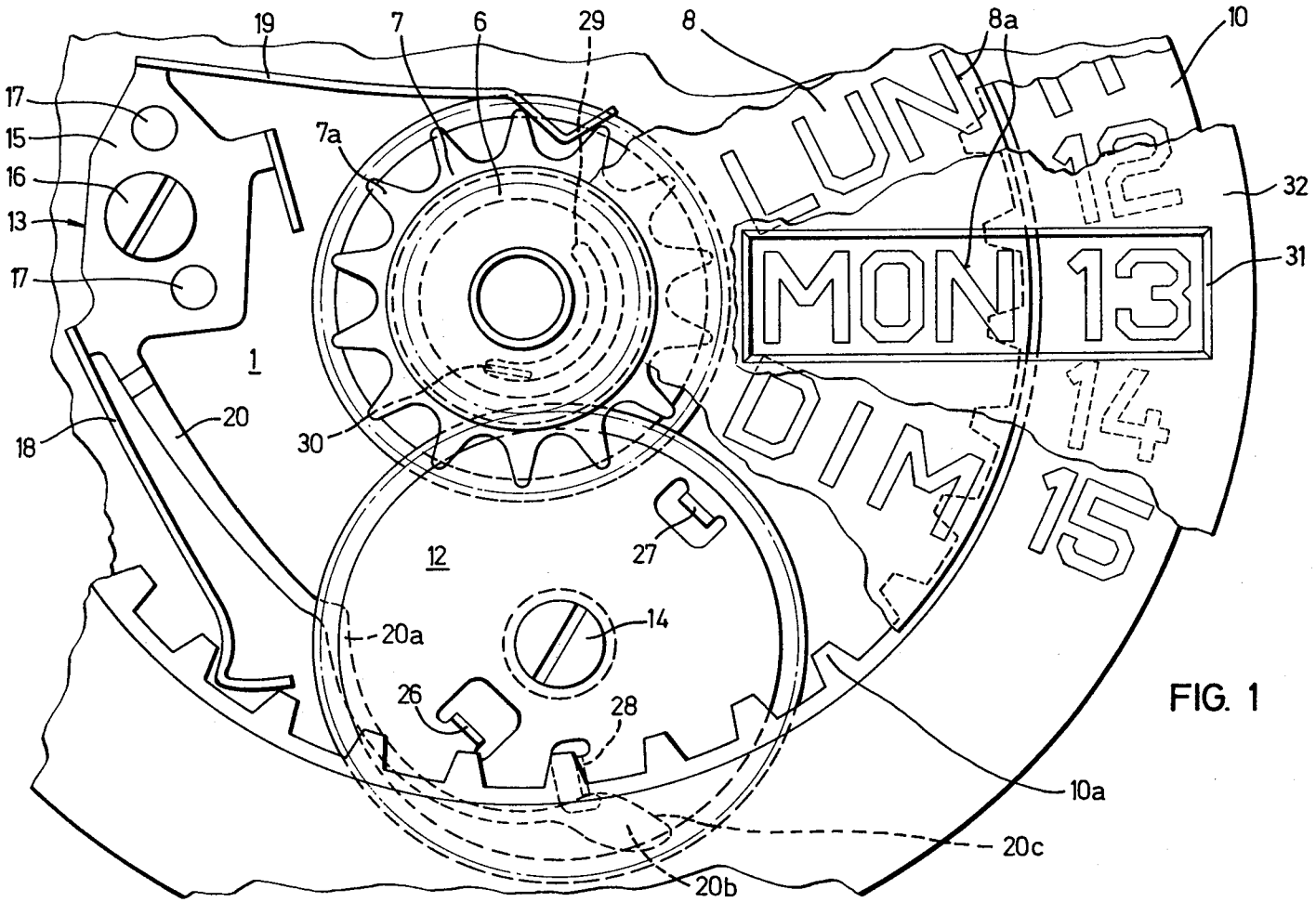
FIG. 1 is a top partial plan view of a watch movement whose calendar mechanism is in a first operating position, that is to say immediately before the switching.
Figure 2:
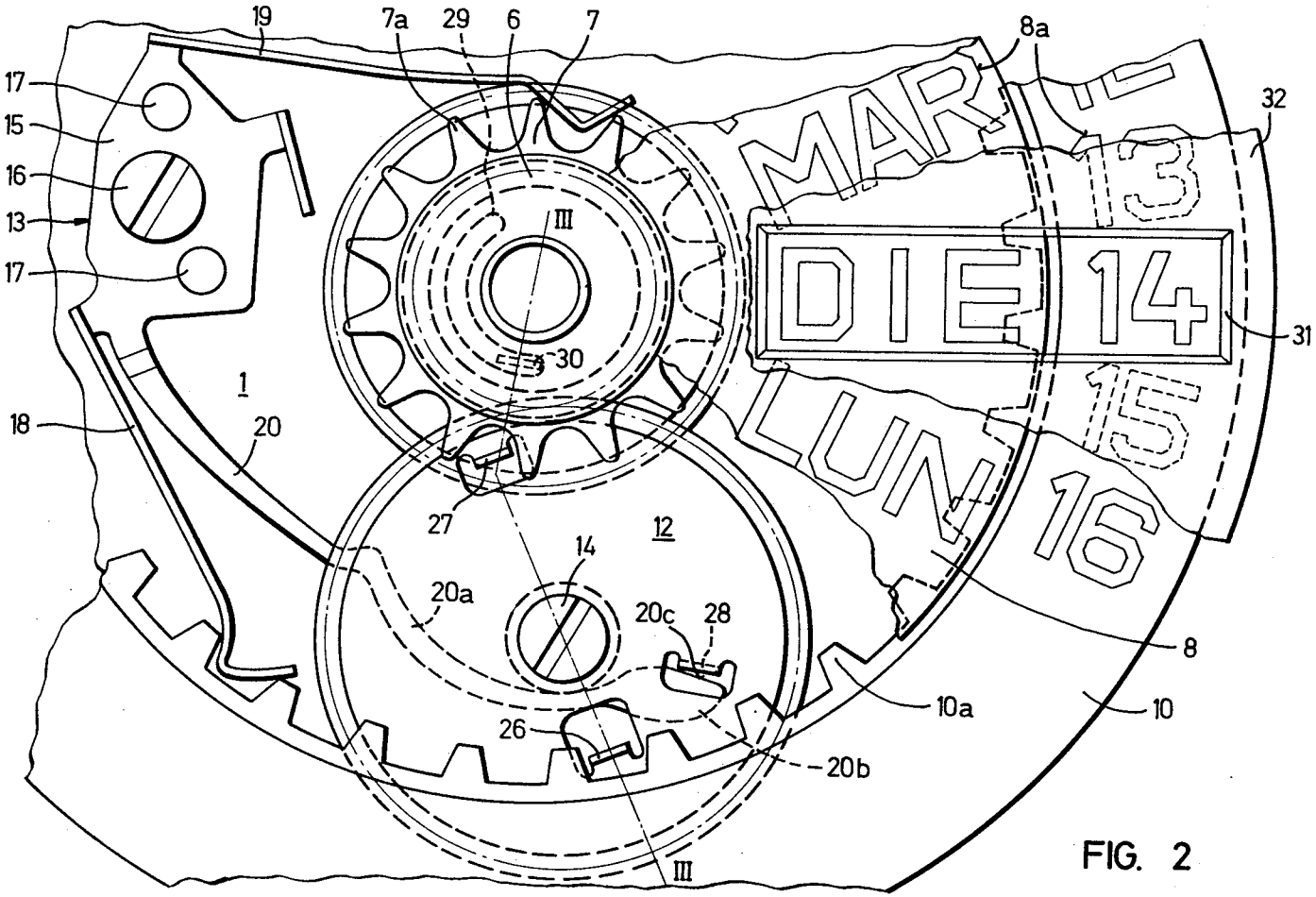
FIG. 2 is a view similar to FIG. 1, showing the position of the calendar mechanism immediately after the switching.
Figure 3:
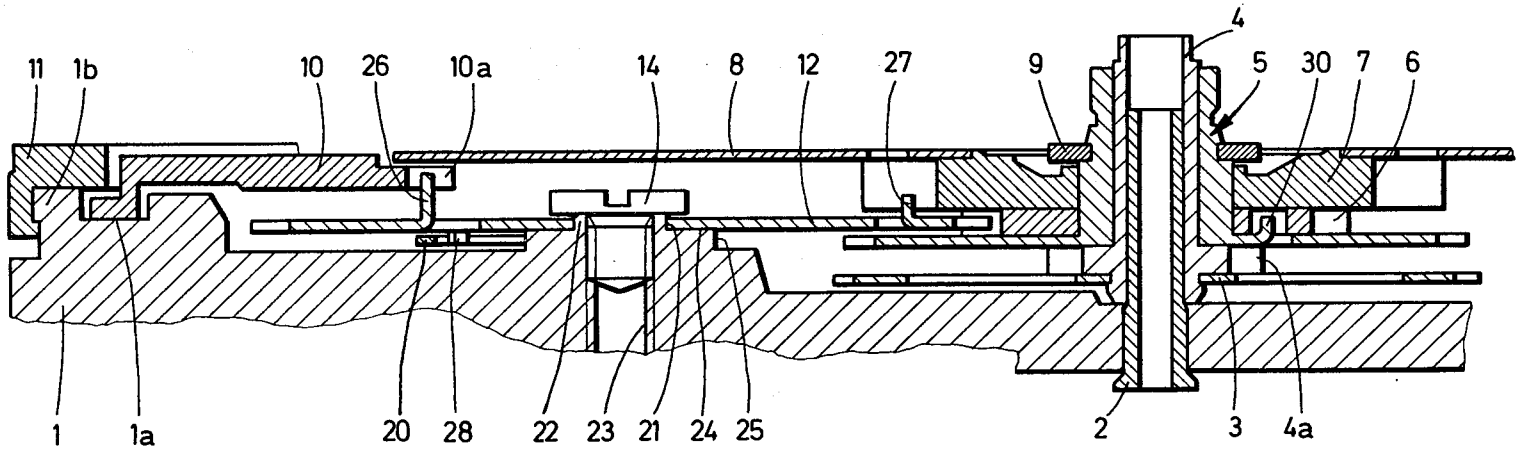
FIG. 3 is a sectional view on a larger scale along the line III—III of FIG. 2.

The calendar watch movement shown in FIGS. 1 to 3 comprises a pillar plate 1, at the center of which there is fastened a tube 2 which guides a center wheel 3 provided with a pipe 4 on which there is mounted an hour wheel 5. The center wheel 3 is driven indirectly, for instance by a large eccentric driving wheel. Its pinion 4*a*, which is integral with the pipe 4, drives a minute wheel (not shown) which in its turn actuates the hour wheel 5. A toothed crown wheel 6 is mounted for rotation on the pipe of the wheel 5. It bears a day star 7 provided with a toothing 7*a* having 14 teeth and equipped with a disk 8 which bears, distributed radially on its upper surface, legends 8*a* representing the names of the days of the week in two languages. The star 7 is held in place axially by a washer 9 which is elastically engaged in a groove milled in the periphery of the pipe of the wheel 5. At its upper end, the pipe of the wheel 5 is machined so as to receive an hour hand while the pipe 4 is machined so as to receive a minute hand.

At is periphery, the pillar plate 1 has a groove 1*a* in which there is engaged a date ring 10 of conventional construction having an inner toothing 10*a* with 31 teeth. This date ring is held in place by a ring 11 engaged on a peripheral rim 1*b* of the pillar plate.

The calendar mechanism which assures the instantaneous switching of the two members 7 and 10 once every 24 hours at about midnight, comprises a total of 5 parts consisting of the hour wheel 5 and the toothed crown 6 as well as a calendar wheel 12, an elastic plate 13 and a retaining screw 14 for the calendar wheel 12. The spring 13 is a steel plate cut out and bent into shape which has a central portion 15 serving for its attachment to the pillar plate by means of a screw 16 and two centering pins 17, a first elastic arm 18 arranged on edge and acting as jumper for the date ring 10, a second elastic arm 19 also bent so as to extend on edge and constituting the jumper of the day star 7 and a third elastic arm 20 bent in such a manner as to extend at a slight distance from the surface of the pillar plate and constituting a calendar spring. As can be noted from FIG. 1, the elastic arm 20, near its free end, has a portion 20*a* which is curved in accordance with a curve designed as a function of the purpose which it is to serve, as will be seen further below, and at its free end a head 20*b* the edge of which constitutes a ramp 20*c* the function of which will also be described further below.

The calendar wheel 12 is made by cutting it out of a metal sheet. It is flat and has a central hole 21 engaged on a drop 22 provided in the pillar plate 1. This drop is provided with an internally threaded hole 23 in which the screw 14 is engaged. The wheel 12 is maintained in a very small axial play between the head of the screw 4 and a shoulder 24 of the pillar plate, said shoulder being itself limited on the outside by a cylindrical inner surface 25 located at the level of the elastic arm 20.

The calendar wheel 12 furthermore has two drive elements 26 and 27 which cooperate with the toothing 10*a* of the calendar ring 10 and the toothing 7*a* of the day star 7, respectively. These two drive elements are manufactured in the same manner, by cutting and bending. First of all a yoke-shaped opening is cut in the plate of the wheel 12, whereupon the inner portion of the yoke is bent at a right angle so as to constitute the protruding element 26 or 27. It will be noted that the height of the protruding element 26 whose radius from the center of the wheel 12 is the smaller, is greater than the height of the element 27 which in its turn is located nearer the toothing of the wheel 12 than the element 26. Upon the rotation of the wheel 12, the element 26 can pass in front of the teeth 7*a* of the star 7, while the element 27 passes below the date ring 10. The wheel 12 also has a third protruding element which constitutes a cocking element 28 which is also formed by the cutting of a yoke-shaped opening and the bending of the inner portion of said opening. The direction of the bend is however opposite that of the elements 26 and 27, so that the element 28 extends opposite the bearing surface 25 and at the level of the elastic arm 20. This cocking element acts as a cam member and during the rotation of the calendar wheel in counterclockwise direction as seen in FIG. 1, it enters into contact with the curved portion of the elastic arm 20 and progressively cocks said arm until the mechanism has reached the position precisely shown in FIG. 1. This figure, shows, as a matter of fact, the maximum cocking position of the elastic arm 20. It will be noted that the curve 20*a* is designed in such a manner that, during the cocking, the moment of resistance exerted by the arm 20 on the calendar wheel 12 is constant.

Before describing the switching function, it is advisable to indicate furthermore how the wheel 12 is driven in rotation in counterclockwise direction around its axis. As can be seen from FIG. 3, the toothing of the wheel 12 is in engagement with the crown 6 referred to above, which it can freely turn on the pipe of the wheel 5. However, it can be seen in FIG. 1 that the toothed crown 6 has a banana-shaped opening 29 which extends over an arc of about 150° coaxially to the crown 6. Furthermore, a tongue 30 which is partially cut-out and bent upward from the plate of the hour wheel 5 is engaged in said opening, thus producing a coupling with angular play between the crown 6 and the pipe wheel 5. As the arc length of the tongue 30 is about 20°, the angular play of the coupling is about 130°. The crown 6 can therefore turn through an angle of 130° with respect to the hour wheel. The corresponding rotation of the calendar wheel 12 is 65°, since the speed reduction ratio of the gearing 6, 12 is 1:2.

This angle of 65° is the angle through which the wheel 12 must turn in order to pass from the position shown in FIG. 1 to the position shown in FIG. 2. Upon this passage, the cocking element 28 arrives onto a curved portion of the ramp 20*c*. As from this moment, it is pushed forward by the elastic arm 20 which relaxes, transferring its cocking energy to the calendar wheel 12. Each of the two drive elements 26 and 27 hooks one of the teeth of the calendar member which they drive. The two members move in rotation at the same time. When the elastic arm 20 strikes against the cylindrical inner surface 25 (FIG. 2), the crown 6 has turned in clockwise direction through an angle such that the end of its opening 29 has come into contact with the spur 30, which prevents any additional rotation. The two elements 26 and 27 being still engaged in the corresponding toothings of the calendar members, these members are themselves blocked and there is no danger of their effecting a double jump. The switching of the two calendar members therefore takes place instantaneously, utilizing reduced energy and without the risk of an improper maneuver.

In accordance with the relative dimensions of the elements of the mechanism, the angle through which the calendar wheel turns upon the switching may be greater or smaller than 65°, so that the length of the banana-shaped opening 29 could also be greater or smaller than the 150° shown in the drawing. This opening could amount to up to 350°.

Between the position shown in FIG. 1, and that shown in FIG. 2, the date ring 10 has advanced one step of its toothing, so that the indication of the date appearing in the window 31 provided in the dial 32 has increased by one unit. At the same time, the day star 7 has been moved two steps of its toothing by the element 27 and therefore 1/7 of a revolution, so that the indication of the next day appears in the window 31, in the same language as in FIG. 1.

The embodiment described above has the advantage that each of the two calendar members is reliably blocked after its jump.

This result is due to the fact that the rotation of the crown 6 is of sufficient amplitude for the end of its opening 29 to come against the spur 30 which is integral with the hour wheel. This arrangement however has the drawback that a correction of any of the calendar members by means of an independent correction member can be effected only while the elements 27 and 26 are engaged in the corresponding toothings of the elements 10 and 7.

The embodiments shown in FIG. 4 to 7 avoid this drawback.

Figure 4:
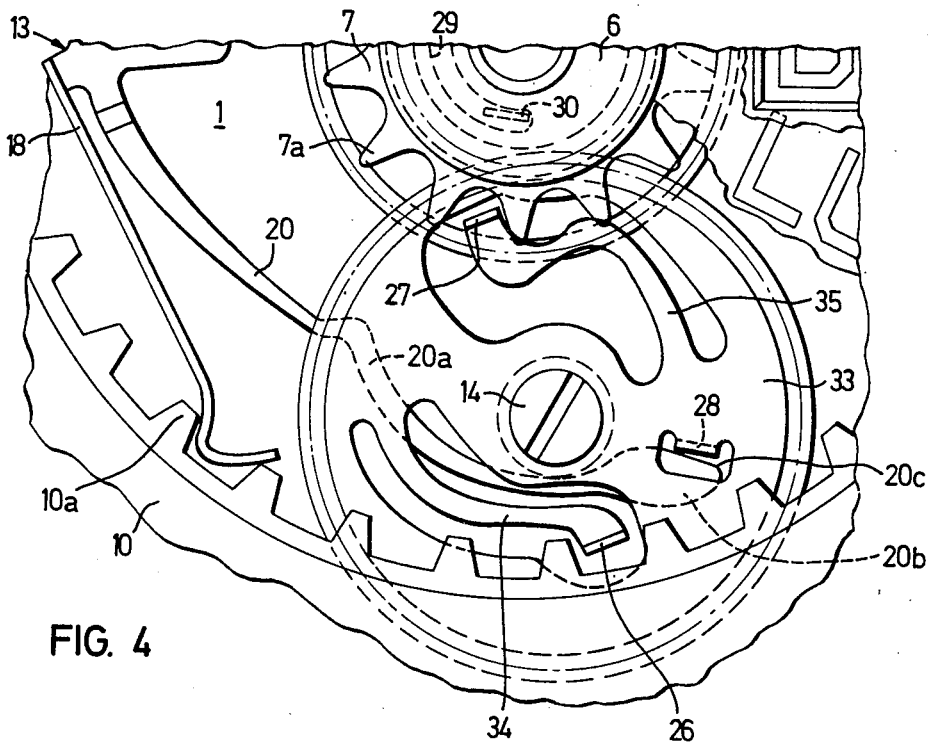
FIGS. 4 to 7 are partial plan views of four variant embodiments of the movement of FIG. 1.

In the variant shown in FIG. 4, the said drawback is eliminated by a structural modification made in the calendar wheel. The crown 6, the spring 13, as well as the other elements of the mechanism, are identical to those which are described in connection with FIGS. 1 to 3. On the other hand, a calendar wheel 23 is used which is cut from a flat plate and which has a cooking element 28 and two drive elements 26 and 27, but the elements 26 and 27 are located at the end of elastic arms 34 and 35 cut out from the plate of the wheel 33. Thus, in the position obtained immediately after the switching, although the members 10 and 7 are blocked as was the case in FIG. 2, the elastic arm 34 can yield if a correction member strives to move the date ring 10 in counterclockwise direction. The tooth of the member 10 which is held by the drive member 26 can pass below said element, which permits rotation of the date ring. Likewise, the day star 7 can turn in clockwise direction, one of its teeth 7*a* pushing back the element 27 by the bending of the arm 35.

Figure 5:
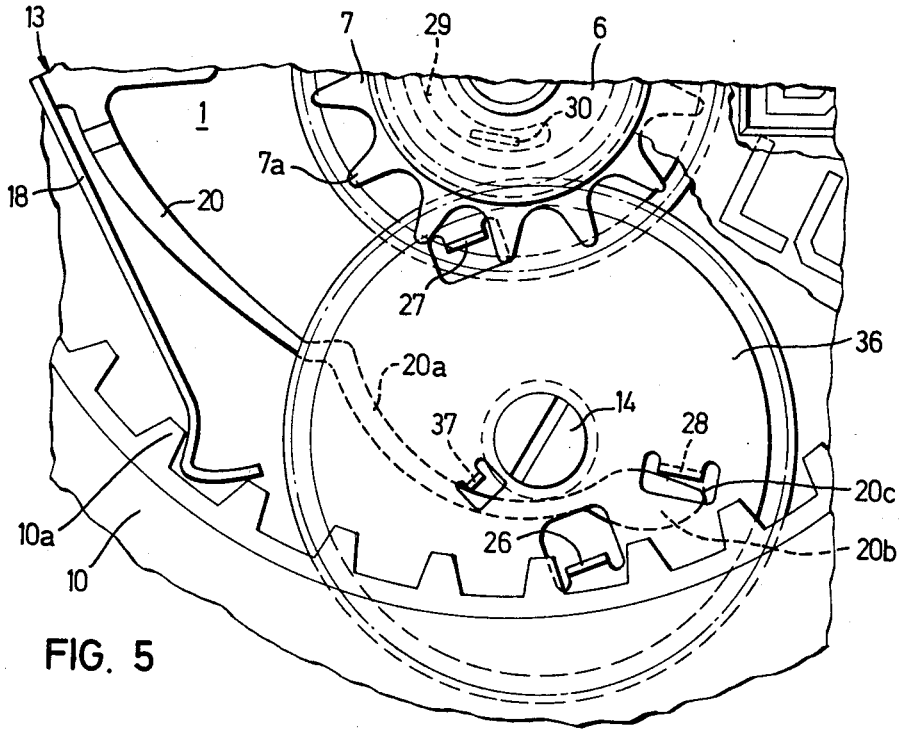

In the variant shown in FIG. 5, the possibility of correcting the indicating members 7 or 10 immediately after the switching is also achieved by a modification made in the calendar wheel 12. However, there is combined with this modification a slight modification made in the crown 6, in the sense that the banana-shaped opening 29 is then slightly longer than was the case in FIGS. 1 to 4. The calendar wheel 36 shown in FIG. 5 comprises, in addition to the drive elements 26 and 27, which are identical here to those of the wheel 12, and the cocking element 28, which is again identical to that of the wheel 12, a blocking element 37 which is shaped like the elements 26, 27 and 28 with a tongue which is cut out and bent at a right angle. This tongue extends on the same side as the cocking element 28 and, as can be noted from FIG. 5, it comes into contact with the portion 20*a* of the arm 20 at the end of the switching. When this tongue strikes against the arm 20*a*, the elements 26 and 27 are still engaged in the toothings 7*a* and 10*a*, but the crown 10 has not yet turned sufficiently for the end of the opening 29 to be in contact with the coupling spur 30. If, therefore, the date ring 10 or the day star 7 is driven by their corrector, the first in counterclockwise direction and the latter in clockwise direction, as seen in FIG. 5, the calendar wheel 36 can carry out a slight movement of rotation in counterclockwise direction, driving the crown 6 along with it in clockwise direction without the hour wheel 5 being acted on. The elastic arm 20 is slightly cocked by the holding element 37 and when the teeth 7*a* or 10*a* have passed below the elements 26 or 27 the mechanism resumes the position shown in FIG. 5.

Figure 6:
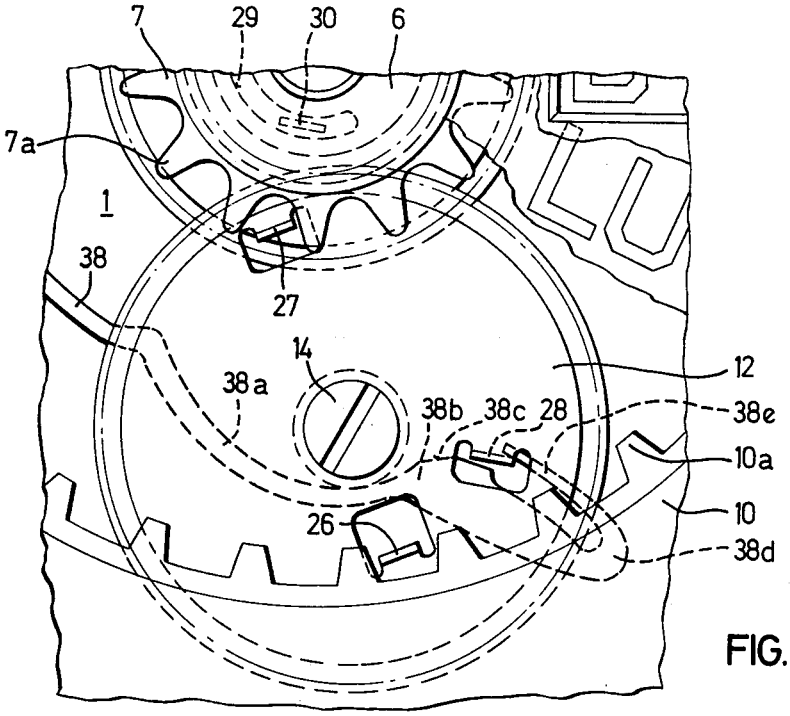
Figure 7:
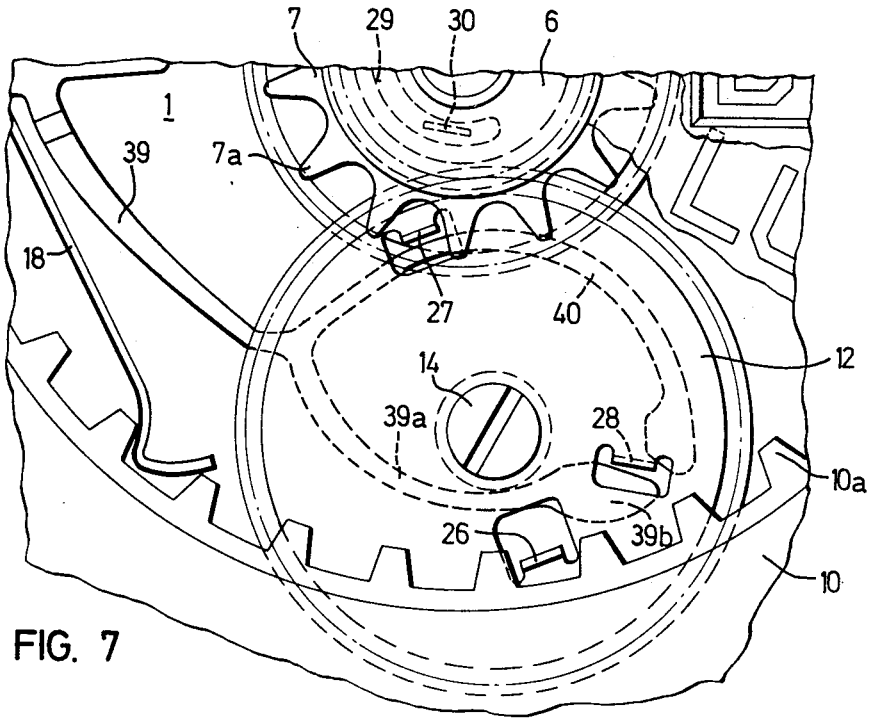

The variants of FIGS. 6 and 7 both use a calendar wheel 12 which is exactly parallel to that of FIG. 1. They furthermore use a toothed crown 6 which has a banana-shaped opening 29 which is slightly extended in a manner similar to that which was described in connection with the variant of FIG. 5. On the other hand, these two variants differ from each other, and also differ from what was shown up to now, in the shape of the elastic arm which constitutes the calendar spring. In the variant of FIG. 6, the calendar spring has an elastic arm 38 provided with a curved portion 38*a* similar to the portion 20*a*, a head 38*b* similar to the head 20*b* provided with a ramp 38*c* similar to the ramp 20*c*, but this elastic arm 38 furthermore has a hook-shaped extension 38*d* which terminates in an elastic tooth 38*e* capable of retaining the cocking element 28 by hooking at the time of the rapid advance of the wheel 12. From the position shown in FIG. 6, a slight rotation of the wheel 12 in counterclockwise direction can take place. It causes an elastic deformation of the finger 38*e*. Once the calendar indicating members have been displaced by the desired angle, the calendar wheel resumes its position of rest, as does the elastic arm 38, as shown in FIG. 6.

In the variant of FIG. 7, the conditions are exactly identical to those of the variant of FIG. 6, except that the elastic arm 29 in this case has a branch 40 which extends opposite the curved portion 39*a* and the end of which is located opposite the head 39*b*. The function of the branch 40 is precisely the same as that of the finger 38*e*.

Figure 8:
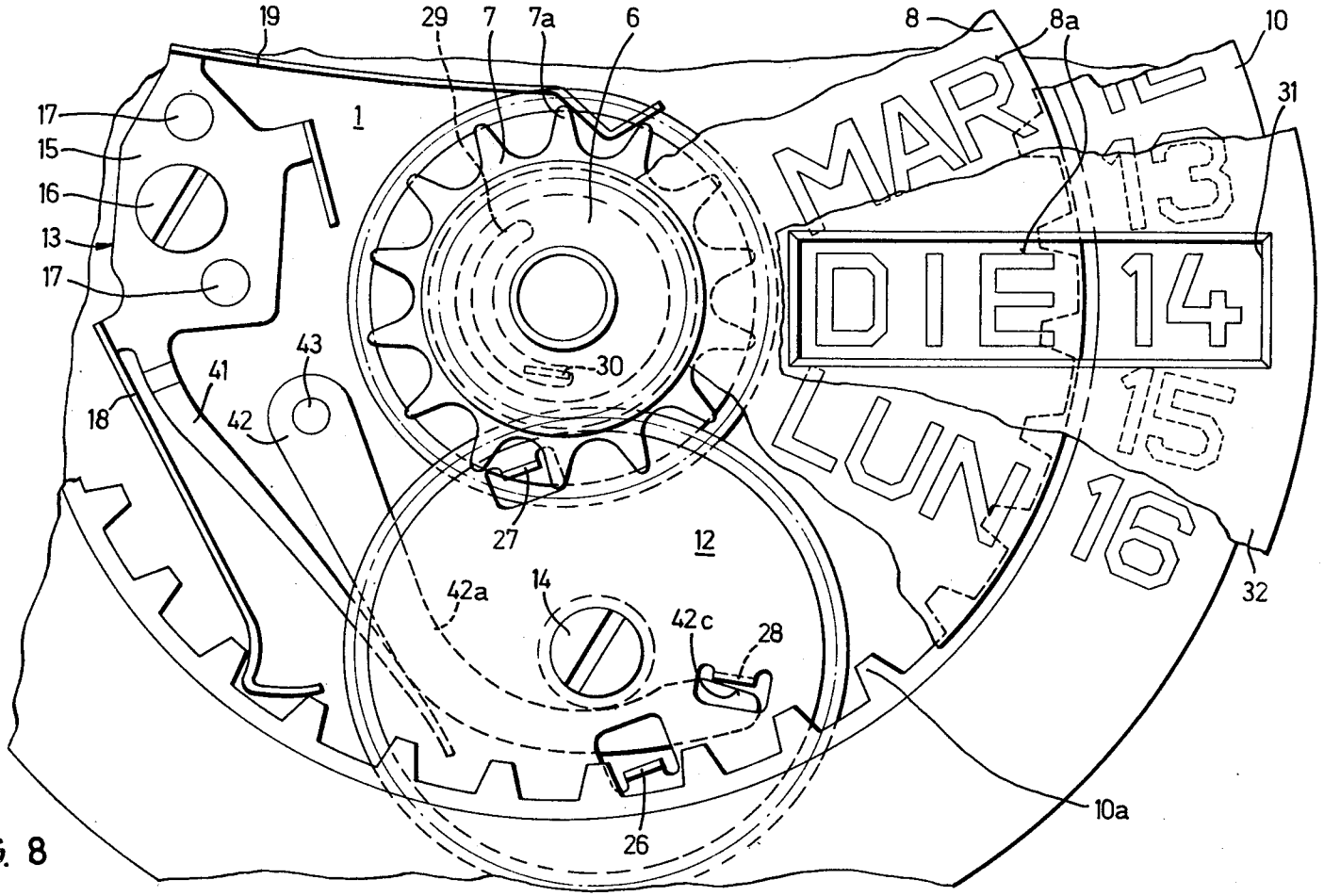
FIG. 8 is a plan view similar to that of FIG. 1, showing another variant.

Finally, FIG. 8 shows an embodiment similar to that of FIG. 1 but in which the elastic arm 41 which serves as calendar spring does not cooperate directly with the element 28 of the wheel 12 but rather with a lever 42 which is pivotally mounted on a stud 43 which is rigidly connected with the pillar plate. The lever 42 has a head-shaped end provided with a ramp 42*c*, which serves the same purpose as the ramp 20*c*, and a curved edge 42*a*, which serves the same purpose as the curved portion 20*a* of the elastic arm 20. The variant embodiments described in connection with FIGS. 4 to 7 may also be provided in the arrangement of FIG. 8, the rigid lever 42 of which makes it possible to assure the switching function with greater precision that an elastic arm, such as the arm 20, for instance.

In all the embodiments of FIGS. 1 to 8, the calendar wheel has a diameter which is twice that of the crown 6. Although this crown itself has a diameter less than that of the hour wheel, this arrangement may give rise to difficulties of arrangement or be the source of difficulties in assembly in the case of certain watch calibers. In order to avoid these difficulties, one could also have the coupling with angular play provided here between the crown 6 and the hour wheel 5 arranged between a wheel and a pinion which together form an intermediate runner the toothing of larger diameter of which meshes directly in the toothing of the hour wheel, while the toothing of small diameter meshes directly in the calendar wheel. One of the two elements of this intermediate runner would then have a protruding spur formed by cutting and bending or by any other method, while the other element would have a banana-shaped opening of a suitable angular length. In such a variant, the calendar wheel, similar to the wheel 12, might be of any diameter.

For this, it would be sufficient for the ratio between the diameters of the elements of the intermediate runner to be such that one obtains a ratio of 2:1 between the hour wheel 5 and the calendar wheel 12.

What is claimed is:

1. Calendar watch movement comprising a calendar indicator provided with teeth, a driving member driven continuously in rotation from the movement, a driven member, means coupling said driving and driven members with angular play, a calendar wheel geared to said driven member to turn one turn each twenty-four hours, elastic rapid advance means, means on said calendar wheel to cock and then absorb the thrust of said elastic rapid advance means to advance said calendar wheel through an arc predetermined by the angular play of said coupling means, and means on said calendar wheel coacting with successive teeth of said indicator member during the advance of the calendar wheel whereby to advance the indicating member by one tooth.

2. Movement according to claim 1, in which said driving member is an hour wheel coaxial to the movement and in which the driven member is an auxiliary crown freely coaxially mounted on the hour wheel.

3. Movement according to claim 1, further characterized by the fact that the said coupling means comprises a tongue borne by one of said members and a coacting banana slot opening in the other of said members to afford angular play in the relative movement between said members.

4. Movement according to claim 1, characterized by the fact that said means on said calendar wheel for coacting with the teeth of said indicator means, and means on said calendar wheel to cock said rapid advance means are tongues partially cut out from the calendar wheel and bent at a right angle.

5. Movement according to claim 4, for a watch movement, further comprising a second indicator provided with teeth, said calendar wheel having additional means thereon for coacting with the teeth of said second indicator.

6. Movement according to claim 5, characterized by the fact that the means for coacting with the teeth of said second indicator is also a tongue cut out from the calendar wheel, each of said tongues being located on different radii of said calendar wheel, and one of said tongues has a height less than the others.

7. Movement according to claim 1, characterized by the fact that the elastic rapid advance means is an elastic arm cut out in one piece with at least one jumper spring, coacting with said teeth of said indicator for the blocking of the same.

8. Movement according to claim 1, characterized by the fact that the elastic rapid advance means is an elastic arm which cooperates directly with the cocking means on the calendar wheel, and by the fact that it is of such shape that it exerts a constant moment of resistance on the calendar wheel during its cocking.

9. Movement according to claim 1, characterized by the fact that the movement has a pillar plate and the elastic rapid advance means is a lever which is pivoted on the pillar plate of the movement, and cooperates with the cocking means which is rigidly connected with the calendar wheel, and is acted on to absorb the thrust of the elastic rapid advance means.

10. Movement according to claim 1, characterized by the fact that it comprises elastic retention means which holds the teeth of the calendar indicator after advance by action of said elastic rapid advance means, while otherwise permitting displacement of the indicator.

* * * * *